US005305904A

United States Patent [19]

Cutts

[11] Patent Number: 5,305,904

[45] Date of Patent: Apr. 26, 1994

[54] FLUID STORAGE TANK

[76] Inventor: William T. Cutts, 14814 Cedar Isle Dr., Houston, Tex. 77084

[21] Appl. No.: 874,689

[22] Filed: Apr. 28, 1992

[51] Int. Cl.[5] ..... B65D 88/40

[52] U.S. Cl. ..... 220/220; 220/216; 220/578

[58] Field of Search ..... 220/216, 220, 578

[56] References Cited

U.S. PATENT DOCUMENTS

Re. 29,270 6/1977 Nelson ..... 220/220

2,554,768 5/1951 Allen ..... 220/216 X

*Primary Examiner*—Allan N. Shoap

*Assistant Examiner*—Paul A. Schwarz

*Attorney, Agent, or Firm*—Bill B. Berryhill

[57] ABSTRACT

An improved fluid storage tank of the type having a bottom, side walls and a floating roof. A plurality of first support legs extend upwardly from the bottom. A plurality of second support legs extend from the floating roof. A power device attached to the floating roof is provided to rotate the roof between a first position in which the first and second support legs are not aligned, allowing the roof to be supported at a first elevation, and a second position in which the first and second support legs are aligned, allowing the roof to be supported at a second elevation.

12 Claims, 5 Drawing Sheets

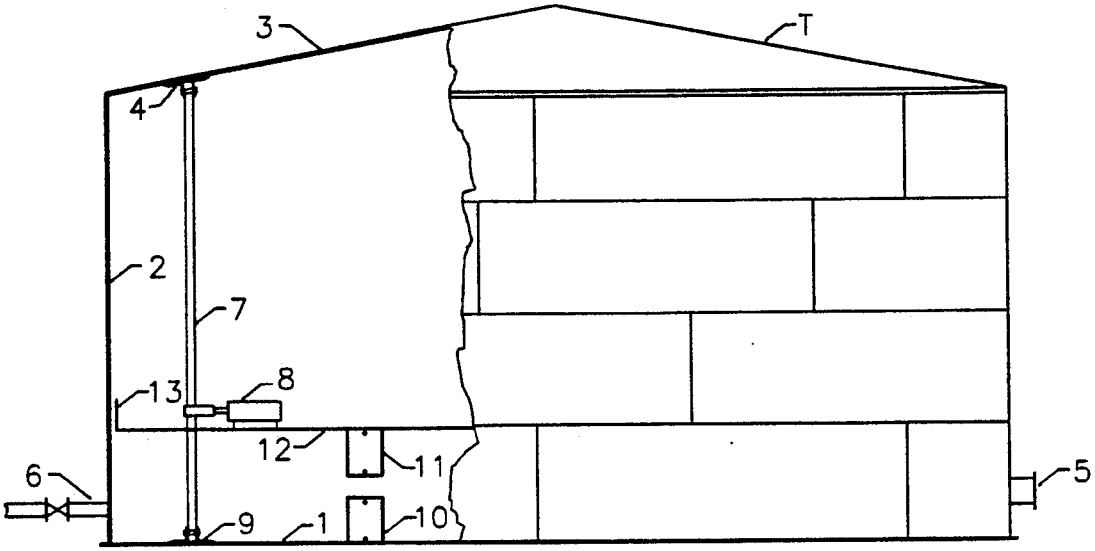
FIG. 1
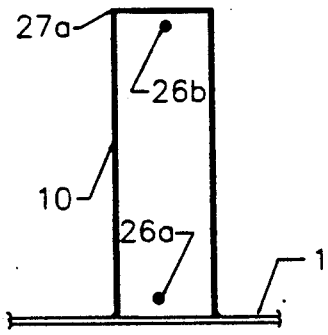
FIG. 2
FIG. 3
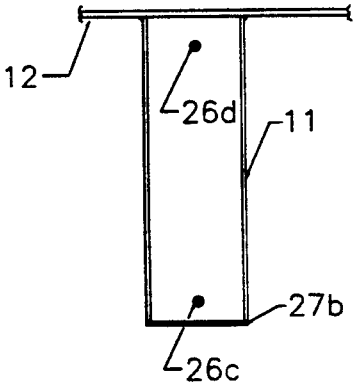

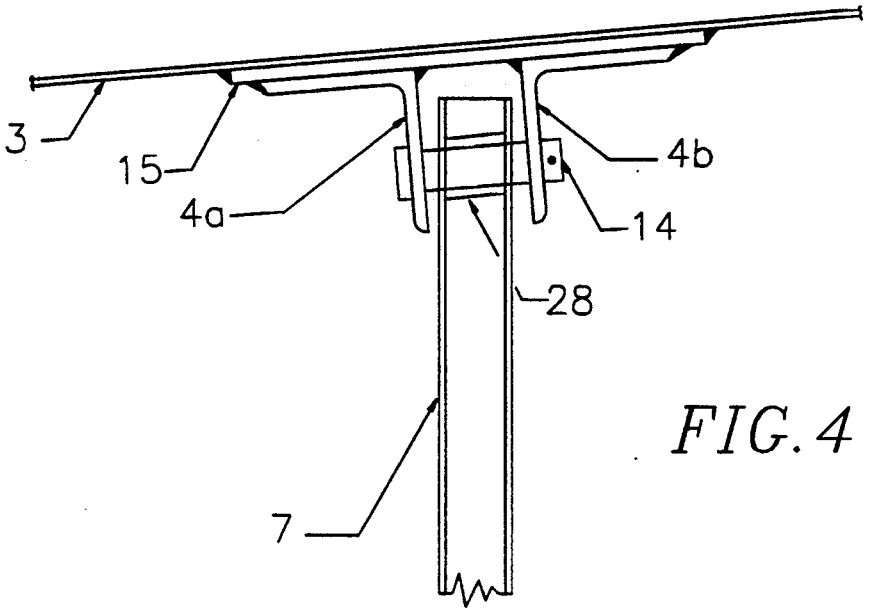
FIG. 4
FIG. 5
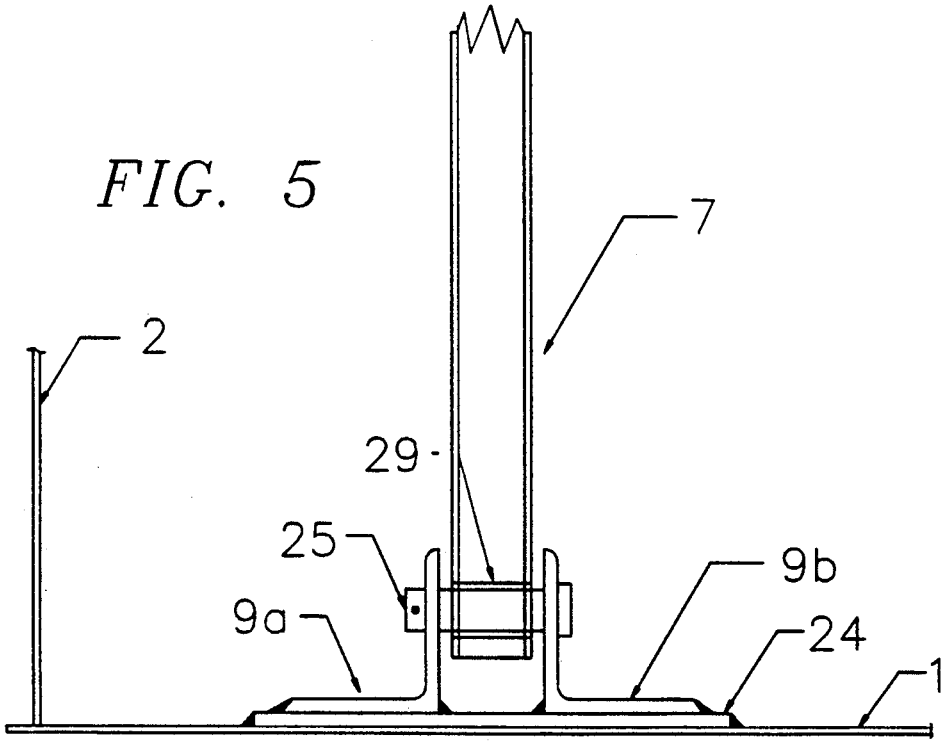

FLUID STORAGE TANK

BACKGROUND OF THE INVENTION

1. Field of the Invention

The present invention pertains to fluid storage tanks. More particularly, the present invention pertains to fluid storage tanks of the type having a floating roof. Specifically, the present invention pertains to a floating roof storage tank in which the floating roof may be supported at more than one elevation above the bottom of the tank, independently of fluid in the tank.

2. Description of the Prior Art

Many types of fluid are stored in tanks having a bottom, vertical side walls and a roof. Many tank roofs are fixed. However, many other tanks are provided with a floating roof which covers the stored fluid but which rides up and down on the fluid surface therein upon changes in the volume of fluids within the tank. Accordingly, vapor space within the tank is kept at a minimum. This reduces the loss of fluids from evaporation and reduces the hazards associated with vapors, particularly hydrocarbon vapors.

The floating roof of a floating roof tank is typically constructed of metal plates welded together to form a circular deck with a rim around its edge to prevent the fluids stored therein from escaping to the top of the floating roof. Most, if not all, floating roof tanks are provided with some type of roof supports which allows the floating roof to be supported at some elevation above the bottom of the tank when there is little or no fluid therein. There is normally a minimum elevation at which the roof should be supported to prevent it from being positioned below tank inlets or outlets since allowing the roof to do so would result in the roof's sinking if additional fluid entered the tank through the inlets or outlets. At other times, it is desirable to support the floating roof at an even higher elevation to provide enough room below the floating roof for performing cleaning, painting or other service operations thereon. This is to allow personnel and equipment easy access and more desirable working conditions under the roof when performing such operations. In addition, work may be carried out in a safe manner Typically, storage tanks with conventional floating roofs are constructed with support legs which support the floating roof at a predetermined elevation from the bottom of the tank. Due to the desire to be able to support the roof at some higher position above the tank bottom, floating roof tanks have also been constructed in which support legs, made of pipe, are attached to the roof and extend both downwardly and upwardly therefrom for sliding engagement with a second smaller diameter pipe. Pins are used to pin the two pipes so that the roof may be supported at different elevations thereon. Of course, this results in several openings through the roof. These openings do not leak liquids due to the sleeve acting as a well. However, such openings do contribute to vapor loss and subject personnel repositioning the legs at different elevations to exposure from vapors and products stored in the tank.

Additional developments have been made in floating roof tanks in which the floating roof may be supported from a fixed roof by support means which are activatable through access openings in the fixed roof. Examples of such may be seen in U.S. Pat. Nos. 3,815,775 and 3,831,800. However, these types of supports require a fixed roof, access therethrough and personnel on top of the tank for operation thereof.

BRIEF DESCRIPTION OF THE PRESENT INVENTION

In the present invention, an improved fluid storage tank of the type having a bottom, side walls and a floating roof is disclosed in which the floating roof may be selectively supported at a first elevation above the bottom and a second elevation above the bottom, independently of the absence of fluid in the tank. A plurality of first support legs are provided which are attached to the tank bottom and extend vertically upward therefrom. A plurality of second support legs are provided which are attached to the floating roof and extend vertically therefrom. Means are also provided for rotating the floating roof about a central axis thereof between a first position in which the first and second support legs are not vertically aligned, allowing the roof to be supported at the first elevation, and a second position in which corresponding ones of the first and second support legs are vertically aligned, allowing the roof to be supported on the support legs at the second elevation.

The means for rotating the floating roof may include a power means attached to the floating roof and being remotely activatable therefrom. In an exemplary embodiment, the power means is a ram device one end of which is attached to the floating roof and an opposite end of which is attached to a stationary member. The ram device is selectively extendable and retractable to provide the force required for rotating the floating roof between first and second positions.

In one embodiment neither of the first or second support legs penetrate the floating roof. In another embodiment, the second support legs extend upwardly from the floating roof. However, they are closed at the end. Thus, there are no holes through which vapors of the stored fluid may escape. Although a fixed roof may be utilized with the floating roof of the present invention, a fixed roof is not required. Thus, the improved fluid storage tank of the present invention provides a floating roof which may be supported at at least two elevations, with or without a fixed roof, safely and with a minimum loss of vapors from the stored fluids. Many other objects and advantages of the invention will be understood from reading the description which follows in conjunction with the accompanying drawings.

BRIEF DESCRIPTION OF THE DRAWINGS

FIG. 1 is an elevation view, partially broken away and in section, of an improved fluid storage tank of the floating roof type, according to a preferred embodiment of the invention;

FIG. 2 is a detailed sectional view of a support leg, attached to the bottom of the tank of FIG. 1, according to a preferred embodiment thereof;

FIG. 3 is a detailed sectional view of a support leg, attached to the underside of the floating roof of the tank of FIG. 1, according to a preferred embodiment thereof;

FIG. 4 is a detailed elevational view of the upper end of a stationary column and its attachment to the fixed roof of the tank of FIG. 1, according to a preferred embodiment thereof;

FIG. 5 is a detailed elevational view of the lower end of the stationary column of FIG. 4 and its attachment to the bottom of the tank shown in FIG. 1, according to a preferred embodiment thereof;

DESCRIPTION OF THE PREFERRED EMBODIMENT

Figure 6:
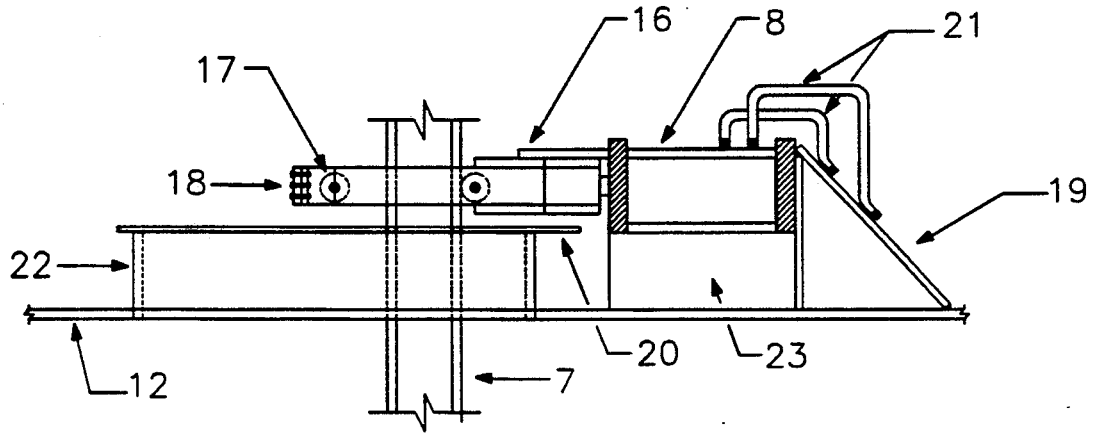
FIG. 6 is an elevation view, partially in section, showing the attachment of power means for rotating the floating roof of the tank of FIG. 1, about a central axis thereof, between first and second predetermined positions, according to a preferred embodiment thereof.

Referring first to FIG. 1 there is shown a metallic tank T having a flat bottom 1, cylindrical side walls 2 and an optional fixed conical roof 3. The cylindrical side walls 2 may be formed by welding sections of metal plate in the form of a cylinder. Miscellaneous inlets 6, outlets (not shown) and manholes 5 may be located in the side walls 2 of the tank T.

Disposed within the tank T for movement therein is a floating roof 12 which includes a circular deck and an upperwardly projecting metallic rim 13. When fluids are stored in the tank T, beneath the floating roof 12, the roof 12 floats upwardly and downwardly on the surface of the fluids stored therein. The rim 13 prevents the fluid from escaping to the upper side of the floating roof 12.

Disposed in the tank T is a stationary column 7 further details of which will be discussed hereafter. For present purposes, it is sufficient to understand that the column 7 is attached to the tank bottom 1 by a lower attachment assembly 9 and to the fixed tank roof 3 by an upper attachment assembly 4. If the tank T is not provided with a fixed roof 3, the upper end of the column 7 may be attached in a suitable fashion to the side walls 2 of the tank T somewhere near the top of the tank T.

Projecting upwardly from the tank bottom 1 is a plurality of first support legs 10 which are preferably seal welded to the tank bottom 1 and capped at the upper or distal end thereof with a cap plate 27*a*. (See also FIG. 2) These first leg supports 10 may also be provided with lower and upper plug holes 26*a*, 26*b*, respectively, for draining if necessary. These first support legs 10 are provided in adequate numbers and at predetermined locations sufficient to support the full weight of the floating roof 12. They preferably terminate at the same elevation. Since tank bottom 1 may slope, the legs may not be exactly equal in length. For practical purposes, they may be said to be of substantially equal length.

Referring also to FIG. 3, a plurality of second support legs 11 are attached to the underside of the floating roof 12 extending vertically downward therefrom. The second support legs 11 are preferably seal welded to the underside of the floating roof deck 12 and may be provided with lower or distal end cap plates 27*b* and lower and upper plug holes 26*c*, 26*d*, respectively, for draining if necessary. In the exemplary embodiment, there are the same number of second support legs 11 as there are first support legs 10. When the floating roof 12 is in a particular rotational position, the first support legs 10 and second support legs 11 are coaxially aligned. However, if the floating roof 12 is rotated a few degrees, the lower support legs 10 and upper support legs 11 are no longer aligned and would not contact each other, even if the floating roof 12 were dropped to its lowermost position.

Referring now also to FIG. 4, the attachment assembly 4 by which the upper end of the stationary column 7 is attached to FIG. 3, includes a reinforcing plate 15 welded on the underside of the roof 3 and two angle support members 4*a*, 4*b* welded thereto. The angle support members 4*a*, 4*b* are provided with holes which are coaxially aligned with a hole 28 through the upper end of the stationary column 7 for insertion of a pin 14 by which the column 7 is stationarily held in place. As previously mentioned, if the tank T is not provided with a fixed roof 3, the upper end of column 7 many be attached to the tank walls 2 in any suitable manner.

Referring also to FIG. 5, the lower end of the column 7 is held in place by an attachment assembly 9 which includes a reinforcing plate 24 welded to the tank bottom 1 to angle support members 9*a*, 9*b*. Each of the angle support members 9*a*, 9*b* are provided with holes coaxially aligned with a hole 29 in the lower end of column 7 for receiving a pin 25 by which the lower end of column 7 is fixed to the tank bottom 1. As best seen in FIG. 6, the support column 7 extends through a sealing well 22 and well seal 20 provided in the floating roof 12. This permits the floating roof 12 to move upwardly or downwardly and with some degree of rotation about its central axis without hindrance from the stationary column 7.

Figure 8:
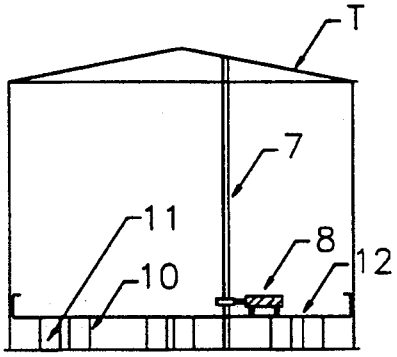
FIGS. 8–13 are schematic elevation views of the improved fluid storage tank of FIG. 1, illustrating various elevational and rotational positions of the floating roof therein, according to a preferred embodiment thereof.

It can easily be understood that if the first leg supports 10 and the second leg supports 11 are not in alignment, such as shown in FIG. 8, the floating roof 12 may float downwardly until the floating roof 12 rests on the second leg supports 11 against the bottom 1 of the tank T and, if they are the same length, against the upper end of the first leg supports 10 at a first and lowermost elevation, as in FIG. 8, even if there are no fluids in the tank T. The floating roof 12 is thus prevented from moving lower than the inlet 6 so that fluids may not escape to the upper side of the floating roof 12, preventing the floating roof 12 from sinking to the bottom of the tank T. However, if the first leg supports 10 and second leg supports 11 are coaxially and vertically aligned, the distal ends of corresponding lower and upper support 10, 11 may engage each other, supporting the floating roof 12 at a second and higher elevation.

Figure 7:
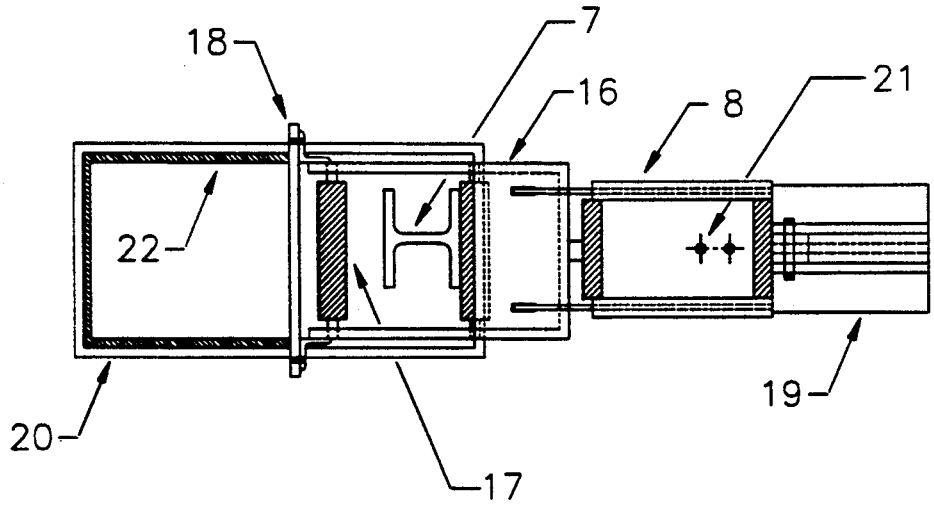
FIG. 7 is a plan view of the power means of FIG. 6, illustrating its attachment to the floating roof and the stationary member of FIG. 1, according to a preferred embodiment thereof.

To effect rotation of the floating roof 12 about a central axis, between a first position in which the first and second support legs 10, 11 are not vertically aligned (FIG. 8) and a second position in which they are aligned (FIG. 11), the tank T is provided with some type of rotating means which in the exemplary embodiment is a ram device 8, details of which are best seen in FIGS. 6 and 7. The ram device 8 is a double acting (push/pull) air or hydraulic piston and cylinder device connected to a source of pressurized fluid through conduits 21. One end of the ram 8 is affixed to the floating roof 12 by a heel support 19 and a lower support 23. As best seen in FIGS. 1 and 8–13, this end of the ram 8 is thus fixed to the floating roof at an eccentric or offset location relative to the central axis of the floating roof 12. The other end of the ram 8 is attached through a coupling 16 collar device 18, in a sliding fashion, to the support column 7. The collar 18 and associated brass rollers 17 provided thereon allow the ram device 8 and the floating roof 12 to move upwardly and downwardly relative to the column 7. However, upon extension or retraction (push/pull) of the ram device 8, a force may be exerted against the stationary column 7 and since one end of the ram device 8 is fixed and mounted eccentrically with the central axis of the floating roof 12, the floating roof 12 will be caused to rotate between a first position, in which the first and second support legs 10, 11 are not vertically aligned and a second position in which they are vertically aligned.

Figure 9:
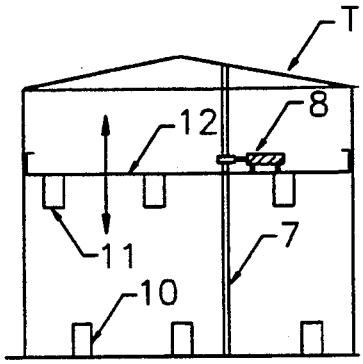

Referring now to FIGS. 8–13, the various positions of the floating roof 12 will be described. In FIG. 8, the floating roof deck 12 is at its first and lowest elevation. The first support legs 10 and second support legs 11 are non-aligned. The stationary column 7 has no force being applied to it so that the roof 12 stays in the position shown even if there are no fluids stored in the tank. FIG. 9 illustrates the floating roof 12 floating on top of fluids stored in the tank T being moved vertically upward from the position of FIG. 8 with no force being applied to the stationary column 7.

Figure 10:
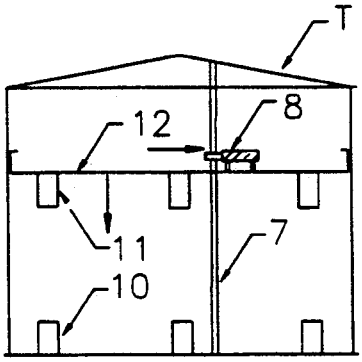
Figure 11:
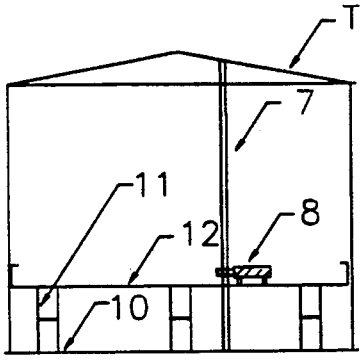

FIG. 10 illustrates the floating roof 12 floating on fluids in the tank T but after a force has been applied to the stationary column 7, through the ram device 8, causing the floating roof 12 to rotate about its central axis and aligning the first leg supports 10 and upper leg supports 11 in coaxial alignment, even though they are not contacting each other. In FIG. 11, the floating roof 12 has descended floating on fluid within the tank so that the first leg supports and second leg supports are now engaging each other supporting the floating roof 12 at a second and higher elevation than the roof was supported in FIG. 8.

Figure 12:
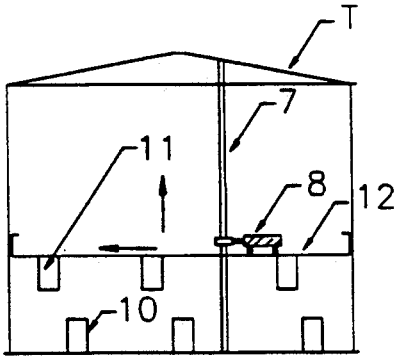
Figure 13:
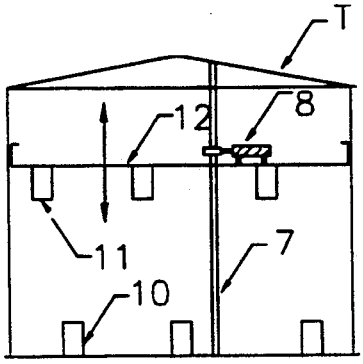

FIG. 12 illustrates the floating roof 12 again floating on the surface of fluids within the tank and after a force has been applied to the column 7 by the ram device 8 so that the first leg supports 10 and second leg supports 11 are no longer in coaxial alignment. As more fluid is introduced into the tank T, as illustrated in FIG. 13, the floating roof 12 continues to float on the surface of the fluids with no forces being exerted against the stationary column 7.

Figure 14:
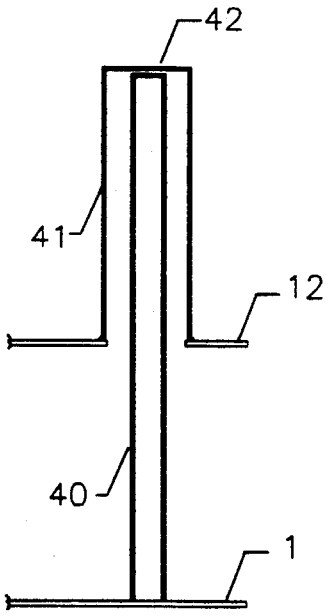
FIGS. 14 and 15 are detailed sectional views of support legs, attached to the bottom and floating roof of a tank, for supporting the floating roof at two elevations, a lower elevation as in FIG. 14 when the legs are aligned, and a higher elevation as in FIG. 15 when the legs are not aligned, according to another embodiment of the invention.
Figure 15:
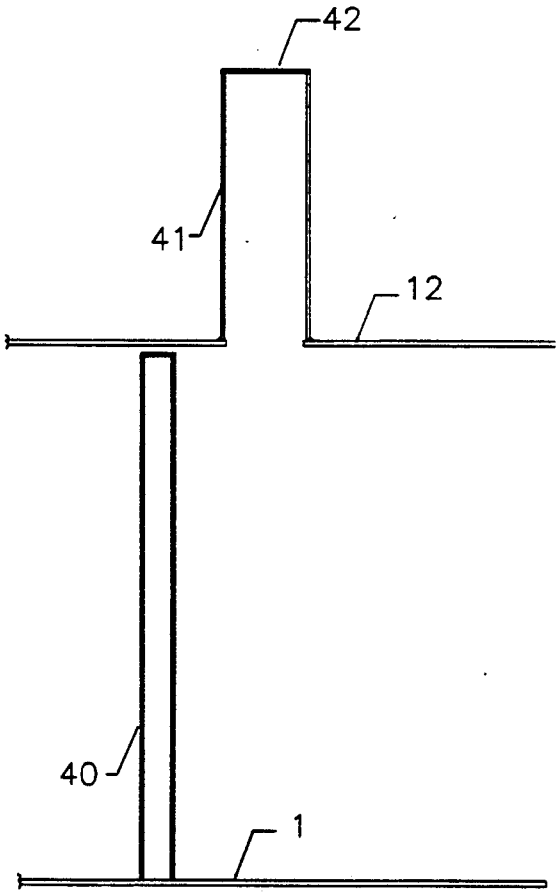

While FIGS. 1–13 illustrate the preferred embodiment of the invention, other embodiments may accomplish the same purpose. For example FIGS. 14 and 15 illustrate an embodiment in which a plurality of first support legs 40 are welded to tank bottom 1 and extend vertically upward therefrom. The first support legs are approximately equal, in length, to both of the first and second support legs 10, 11 of the embodiment of FIGS. 1–13.

Second support legs 41 extend vertically upward from the floating roof 12. These legs 41, tubular and preferably cylindrical in shape and closed at their upper end by plates 42, are large enough in diameter to telescopically receive a portion of the first support legs 40, as shown in FIG. 14

When the legs 40 and 41 are vertically aligned, as in FIG. 14, the floating roof is supported on the legs 40 and 41 at a first elevation. When they are not vertically aligned, as illustrated in FIG. 15, the floating roof is supported on the upper end of legs 40 at a second and higher elevation.

The same mechanisms, such as the ram device 8 of FIGS. 6 and 7, may be used to rotate the floating roof 12 between a first position in which the legs 40 and 41 are not aligned (FIG. 15) and a second position in which they are aligned (FIG. 14). Of course, rotation of the floating roof 12 may be accomplished only when the floating roof is high enough to assure that the legs 40 do not internally engage the legs 41.

Thus, the fluid storage tank of the present invention is uniquely provided with two sets of support legs, a first set extending upwardly from the bottom of the tank and a second set extending downwardly or upwardly from the floating roof. The roof is provided with power means by which it may be rotated about a central axis between a first position in which the first and second support legs are not vertically aligned, allowing the roof to the supported at a first elevation, and a second position in which corresponding ones of the first and second support legs are vertically aligned, allowing the roof to be supported at a second elevation independently of the absence of fluids in the tank. One position allows the roof to be supported at a low elevation but preventing the roof from sinking to the bottom of the tank in the absence of fluids therein and the other position supports the roof at a higher elevation to permit personnel and equipment to enter the tank for cleaning, painting or other maintenance operations with plenty of room and safety to perform such operations.

While two embodiments of the invention have been described herein, many variations thereof can be made without departing from the spirit of the invention. Accordingly, it is intended that the scope of the invention be limited only by the claims which follow.

I claim:

1. An improved fluid storage tank of the type having a bottom, side walls and a floating roof in which the improvement comprises support means for selectively supporting said floating roof at a first elevation above said bottom and a second elevation above said bottom, independently of the fluid in said tank, said support means comprising:

a plurality of first support legs attached to said bottom and extending vertically upward therefrom;

a plurality of second support legs attached to said floating roof and extending vertically therefrom; and means for rotating said floating roof about a central axis thereof between a first position in which said first and second support legs are not vertically aligned, allowing said roof to be supported on said support means at said first elevation, and a second position in which corresponding ones of said first and second support legs are vertically aligned, allowing said roof to be supported on said support means at said second elevation.

2. An improved fluid storage tank as set forth in claim 1 in which all of said first support legs are of substantially equal length.

3. An improved fluid storage tank as set forth in claim 1 in which all of said second support legs are of substantially equal length.

4. An improved fluid storage tank as set forth in claim 1 in which all of said first and second support legs are of substantially equal length.

5. An improved fluid storage tank as set forth in claim 1 in which said first support legs are substantially longer than said second support legs.

6. An improved fluid storage tank as set forth in claim 1 in which none of said first and second support legs penetrate said floating roof.

7. An improved fluid storage tank as set forth in claim 1 in which said second support legs extend upwardly from said floating roof and are tubular for telescopically receiving an upper portion of said second support legs when said floating roof is in said second position.

8. An improved fluid storage tank as set forth in claim 1 in which said rotating means comprises power means attached to said floating roof and being remotely activatable therefrom for rotating said floating roof between said first and second positions.

9. An improved fluid storage tank as set forth in claim 8 in which said power means comprises at least one ram device one end of which is fixed and attached to said floating roof, eccentrically relative to said central axis, and an opposite end of which is attached to a stationary member, said ram device being selectively extendable and retractable to provide the force required for rotating said floating roof between said first and second positions.

10. An improved storage tank as set forth in claim 9 in which said stationary member comprises a column fixed within said tank and positioned vertically therein.

11. An improved storage tank as set forth in claim 10 in which said opposite end of said ram device slidingly engages said column to allow said floating roof and said ram device to float on fluids within said tank without affecting the rotational position of said floating roof.

12. An improved storage tank as set forth in claim 9 in which said one end of said ram device is eccentrically attached to said floating roof at a predetermined distance from said central axis.

* * * * *